US007843289B1

(12) United States Patent
Raklyar et al.

(10) Patent No.: US 7,843,289 B1
(45) Date of Patent: Nov. 30, 2010

(54) HIGH RELIABILITY MICROWAVE MECHANICAL SWITCH

(75) Inventors: Aron Raklyar, Brooklyn, NY (US); Gennady Simkin, Brooklyn, NY (US); Efim Polishchuk, Brooklyn, NY (US)

(73) Assignee: Scientific Components Corporation, Brooklyn, NY (US)

( * ) Notice: Subject to any disclaimer, the term of this patent is extended or adjusted under 35 U.S.C. 154(b) by 408 days.

(21) Appl. No.: 12/150,069

(22) Filed: Apr. 23, 2008

Related U.S. Application Data

(63) Continuation-in-part of application No. 11/207,025, filed on Aug. 19, 2005, now abandoned.

(51) Int. Cl.

| | |
|---|---|
| ***H01H 53/00*** | (2006.01) |
| ***H01H 51/34*** | (2006.01) |
| ***H01H 51/30*** | (2006.01) |
| ***H01H 63/02*** | (2006.01) |
| ***H01H 7/16*** | (2006.01) |
| ***H01H 75/00*** | (2006.01) |
| ***H01H 77/00*** | (2006.01) |
| ***H01H 1/00*** | (2006.01) |
| ***H01H 67/02*** | (2006.01) |
| ***H01H 15/00*** | (2006.01) |
| ***H01H 1/12*** | (2006.01) |

(52) U.S. Cl. ..... 335/4; 335/5; 335/90; 335/105; 335/133; 335/156; 335/196; 335/97; 335/107; 335/121; 335/179; 335/185; 335/229; 200/16 R; 200/51.04; 200/504

(58) Field of Classification Search ..... 335/4, 335/5, 15, 60, 71, 72, 83, 90, 97, 105, 107, 335/121, 124, 128, 133, 151, 153, 154, 156, 335/179, 185, 189, 190, 192, 193, 195, 196, 335/199, 202, 205, 229, 271, 277; 200/16 R, 200/51.04, 504; 333/103–109
See application file for complete search history.

(56) References Cited

U.S. PATENT DOCUMENTS

| | | | | | |
|---|---|---|---|---|---|
| 3,987,384 | A | * | 10/1976 | Bohlke et al. | 335/105 |
| 4,063,204 | A | * | 12/1977 | McFarlin | 335/193 |
| 4,298,847 | A | | 11/1981 | Hoffman | |
| 4,547,639 | A | * | 10/1985 | Watanabe et al. | 218/130 |
| 4,564,828 | A | * | 1/1986 | Lowe | 335/128 |
| 4,697,056 | A | | 9/1987 | Hoffman | |
| 4,737,750 | A | * | 4/1988 | Prouty | 335/177 |
| 4,908,588 | A | | 3/1990 | Hoffman et al. | |
| 5,063,364 | A | * | 11/1991 | Tsoi | 333/107 |
| 5,272,458 | A | | 12/1993 | Hoffman | |
| 5,499,006 | A | | 3/1996 | Engel et al. | |
| 5,642,086 | A | | 6/1997 | Nelson | |
| 5,652,558 | A | | 7/1997 | Leikus et al. | |
| 5,699,030 | A | | 12/1997 | Leikus et al. | |

(Continued)

*Primary Examiner*—Elvin G Enad
*Assistant Examiner*—Mohamad A Musleh
(74) *Attorney, Agent, or Firm*—Siegmar Silber, Esq.

(57) ABSTRACT

An improved electromechanical switch designed to operate at frequencies from DC through microwave has terminal probe tips that are formed from an alloy of noble metal and contoured with a pattern of peaks and valleys in order to provide better contact wiping operation and capture of wear debris. The switch incorporates damper elements to reduce switching contact bounce, thus providing increased contact life as well as higher quality signal switching.

16 Claims, 5 Drawing Sheets

U.S. PATENT DOCUMENTS

| | | | | |
|---|---|---|---|---|
| 5,724,014 | A | 3/1998 | Leikus et al. | |
| 5,748,055 | A | 5/1998 | Ors | |
| 5,815,049 | A | 9/1998 | Cappelli | |
| 5,815,057 | A | 9/1998 | Hoffman et al. | |
| 5,894,255 | A | 4/1999 | Wallintin | |
| 5,973,577 | A | 10/1999 | Karlsson | |
| 6,037,849 | A | 3/2000 | Ciezarek | |
| 6,043,440 | A | 3/2000 | Sun et al. | |
| 6,124,771 | A | 9/2000 | Kim et al. | |
| 6,133,812 | A | 10/2000 | Magda | |
| 6,204,740 | B1 | 3/2001 | Nakahata | |
| 6,211,756 | B1 | 4/2001 | Sun et al. | |
| 6,337,612 | B1 | 1/2002 | Kim et al. | |
| 6,340,923 | B1 * | 1/2002 | Yamanaka et al. | 335/4 |
| 6,414,577 | B1 | 7/2002 | Hoffman | |
| 6,650,210 | B1 | 11/2003 | Raklyar et al. | |
| 7,046,101 | B2 * | 5/2006 | Mruz et al. | 333/101 |

* cited by examiner

HIGH RELIABILITY MICROWAVE MECHANICAL SWITCH

CROSS-REFERENCES TO RELATED APPLICATIONS

This application is a continuation-in-part of U.S. patent application entitled ELECTROMECHANICAL RF SWITCH, Ser. No. 11/207,025 filed Aug. 19, 2005 now abandoned.

BACKGROUND OF THE INVENTION

1. Field of the Invention

This invention relates to electromechanical relays for switching high-frequency signals with high reliability, stable insertion loss, stable return loss and high isolation.

2. Description of the Prior Art

Many different types of switches are known for the switching of radio frequency signals and other signals. Some switch types include spring actuated contacts, electromagnetic actuators, plungers with permanent magnets, articulated joints and other movable elements. Examples of these types of switches are shown in U.S. Pat. Nos. 6,340,923; 6,337,612; 6,204,740; 6,124,771; 5,894,255; 5,815,049; 5,724,014; 5,699,030; 5,652,558; and, 5,499,006. The switches using conductive reeds or similar elements generally use a conductive element made from beryllium copper which is plated with a high conductivity material. Unfortunately these switch types suffer from poor reliability and low switch lifetime. Plating variations contribute to variations in contact resistance, which in turn affect the life of the switch. Additionally, the life of a switch depends on how quickly the electrical contact surfaces develop a layer of contamination. By making the reed of thinner and more flexible material than is generally found with plated beryllium copper, a so-called "wiping action" is able to take place that will remove contaminants during each switching cycle.

Other examples of radio frequency (RF) switches are shown in U.S. Pat. Nos. 6,133,812; 6,037,849; 4,908,588; 4,697,056; and, 4,298,847. The RF switches shown in these patents use several cylindrical guide pins to guide the reed conductors in an up and down motion preventing contact between the reed conductors and the walls of the surrounding RF channels.

Guide pin wear is a significant component in the loss of reliability of RF switches and thus in potential early failure. One method of reducing wear in the guide pins is to increase the contact area between the guide pins and the reed conductors. This method is illustrated in U.S. Pat. Nos. 5,815,057 and 5,642,086.

A further improvement to RF switches is offered by U.S. Pat. No. 6,650,210, in which U-shaped guide members increase the lifetime of the RF switch by reducing stresses in the contact area between the reed conductors and the guide pins. However, the form of the prior art 2-part enclosure leads to some performance problems. The U-shaped guide members require extremely precise locating in the switch, otherwise wear becomes excessive and failure-inducing wear particles are generated. Also, the case has concentric holes into which actuators are installed and reed holders are located. The reed holders move within these holes to bring the reeds between contacting and non-contacting positions. Because of the structure of the case, the holes are partially blind and cannot be machined with very high precision. Additionally, the outside of the case wall forms part of the RF cavity for the switch and also serves as ground. Thus, the wall and therefore the whole case requires plating with high conductivity material. As the plating adds dimensional variations, problems with electrical performance may result. A further problem with prior art switches occurs when, during operation, a portion of the reed holder rubs against the inside of the RF cavity creates additional wear particles. Even with the improvements in the prior art devices which may offer a lifespan of up to 2 million cycles, a need remains for an RF switch that has a longer lifespan and higher reliability with precision operation. Rather than using the traditional 2-part case of the prior art, a more reliable switch may be made with a 3-part case which eliminates the need for machining blind holes and performing unnecessary plating.

SUMMARY

The improved electromechanical RF switch described herein provides enhanced reliability and switching operation for at least million cycles by using thin, flexible reeds and switching terminal probe tips all made of alloys of noble metal rather than by using plated components to lower contact resistance, and by contouring the probe tips with a series of peaks and valleys to trap any wear particles generated by switch operation in the cavities formed by the valleys. Further, the incorporation of a damping element in a cavity formed in the switch case limits switch contact bounce by the reeds and thus there is a further reduction in the wear experienced by the switch contacts during switching and a further gain in switch longevity and reliability.

OBJECTS AND FEATURES OF THE INVENTION

It is an object of the present invention to provide an electromechanical RF switch with increased switching lifespan and increased reliability.

It is a feature of the present invention to have switch terminal probe tips made from a noble metal or an alloy of noble metals.

It is a further feature of the present invention to have switch terminal probe tips contoured with a series of peaks and valleys such that the cavities formed by the valleys serve to trap any wear particles generated by switch operation.

It is still another feature of the present invention to have a lubricant deposited on the terminal probe tips to improve contact wiping action, wherein a portion of the lubricant accumulates in the cavities formed by the valleys and serves to further aid in capturing any wear particles, and as dried and contaminated lubricant accumulates in the cavities, fresher lubricant is still available to improve contact wiping action.

It is a further object of the present invention to provide an electromechanical RF switch with decreased contact bounce during switching operation.

It is yet another feature of the present invention to have a damping element made of elastic material that functions to reduce switching contact bounce, thus further reducing switch contact wear and providing higher life expectancy.

BRIEF DESCRIPTION OF THE DRAWINGS

The present version of the invention will be more fully understood with reference to the following Detailed Description in conjunction with the drawings of which.

DESCRIPTION OF THE PREFERRED EMBODIMENT AND BEST MODE

The invention described herein is a high reliability microwave mechanical switch incorporating probe tips contoured with a pattern of peaks and valleys and composed of a noble metal or an alloy of noble metals, and incorporating damper elements made of elastic material to reduce reed bounce during switch operation.

Figure 1:
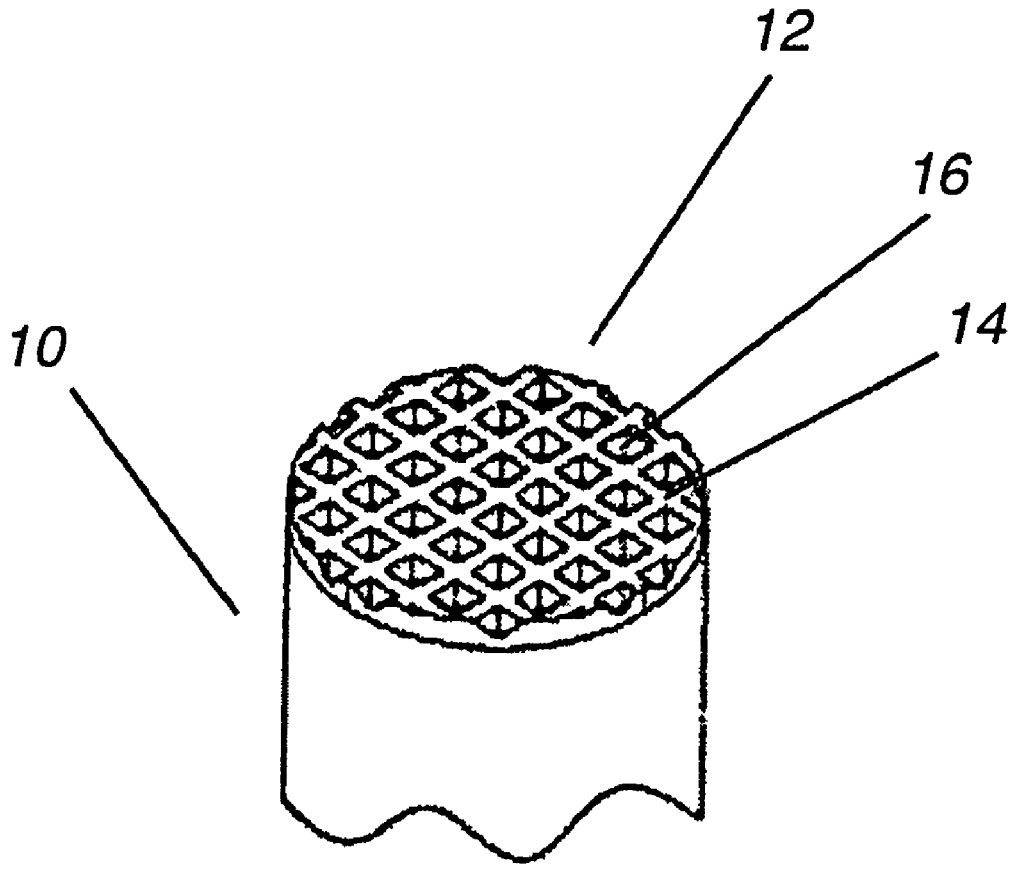
FIG. 1 is a perspective view of a terminal probe tip.
Figure 2A:
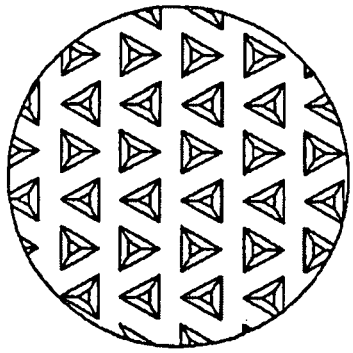
FIGS. 2A-H are plan views of alternate terminal probe tip contour patterns.
Figure 2B:
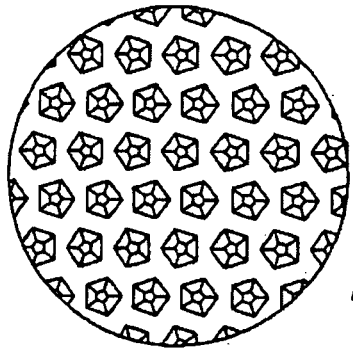
Figure 2C:
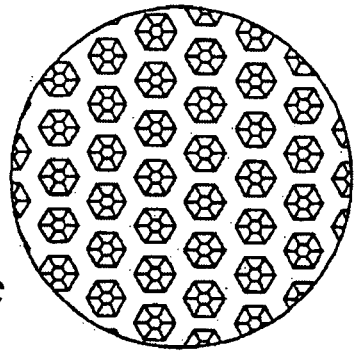
Figure 2D:
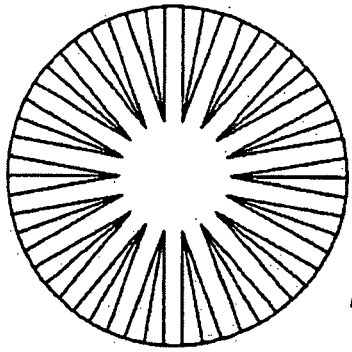
Figure 2E:
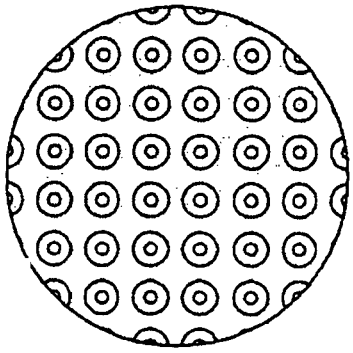
Figure 2F:
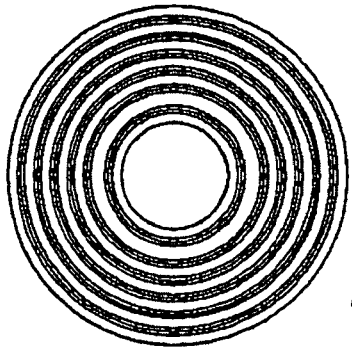
Figure 2G:
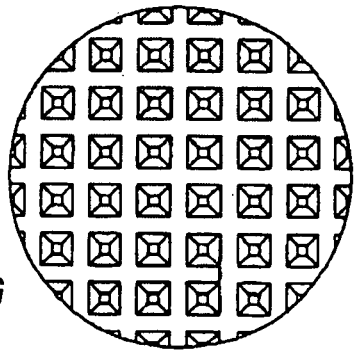
Figure 2H:
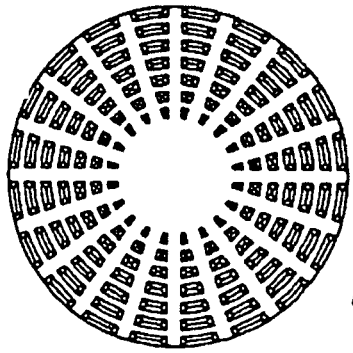

The terminal probe 10 is shown in FIG. 1 with a probe tip incorporating a pattern of peaks 14 and valleys 16. This particular pattern of peaks 14 and valleys 16 is the preferred embodiment known as a waffle pattern, after the shape commonly seen embossed in the surface of the food item of the same name. The peaks 14 provide a continuously clean electrical contact surface and the valleys 16 serve to capture any debris that may form as a result of contact wear experienced during contact make and break when switching. In the preferred embodiment, the contact elements are reeds made of thin and flexible strips of an alloy of noble metals. By manufacturing the probe tip 12 from a noble metal or an alloy of noble metals, the wear-induced contact resistance increase experienced by plated probe tips is avoided. In the preferred embodiment, the alloy of noble metal is 24 karat (pure) gold.

FIGS. 2A-H illustrate some of the alternate patterns of peaks and valleys, where any closely spaced pattern may be used.

Figure 3:
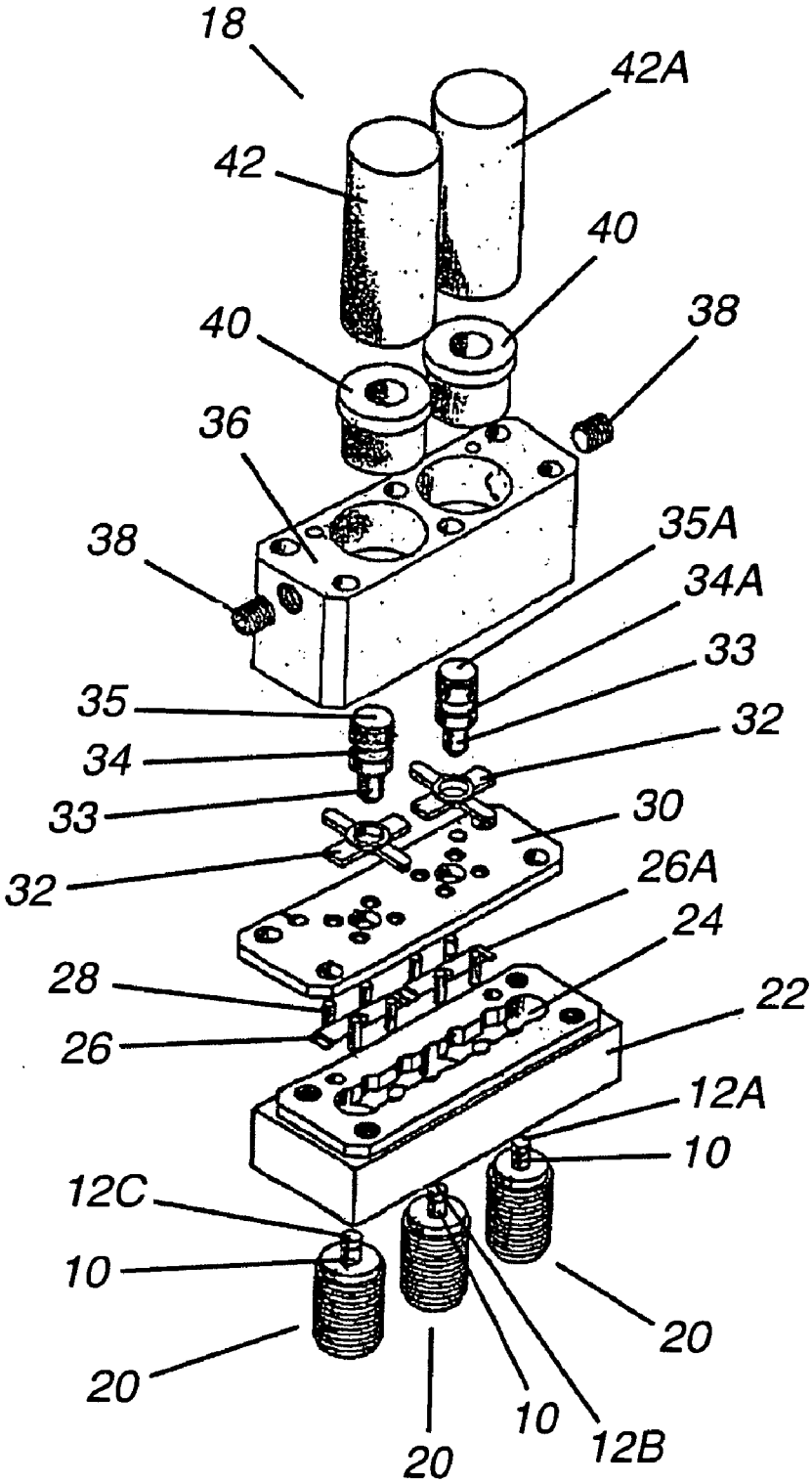
FIG. 3 is an exploded perspective view of a microwave mechanical switch incorporating damper elements and terminal probe tips.

An exploded view of the entire microwave mechanical switch assembly 18 can be seen in FIG. 3. The terminals 20 each have a terminal probe 10 ending in a probe tip 12. The terminals 20 are inserted into holes in the lower face of the base 22 and the terminal probes 10 protrude into the base slot 24, where the probe tips 12A, 12B and 12C are in proximity with the reeds 26 and 26A which are capable of being moved vertically in the base slot 24, guided by the guide pins 28. In the preferred embodiment, the reeds 26 and 26A are thin and flexible, approximately 0.003" thick, and made from an alloy of noble metal, and the guide pins 28 are made from a wear-resistant material such as glass.

The midplate 30 covers the upper face of the base 22, forming the RF cavity/channel, and captures the reeds 26 and 26A within the base slot 24. The reed holders 34 and 34A protrude through holes in the midplate 30 and each has a reed attachment end 33 that is fastened to reed 26 and 26A. At the opposite end of the reed holders 34 and 34A, permanent magnets 35 and 35A are fastened. The reed holders 34 and 34A are axially positioned within bushings 40 which are located within holes in the case 36. The bushings 40 are preferably made of a low-friction material and may be additionally lubricated for smoother travel of the reed holders 34 and 34A. Axial travel of the reed holders 34 and 34A is controlled by the core-containing actuators 42 and 42A, which are secured in place with set screws 38. Dampers 32, which are optional, are shown positioned between the midplate 30 and the main portion of each reed holder 34 and 34A.

Figure 4:
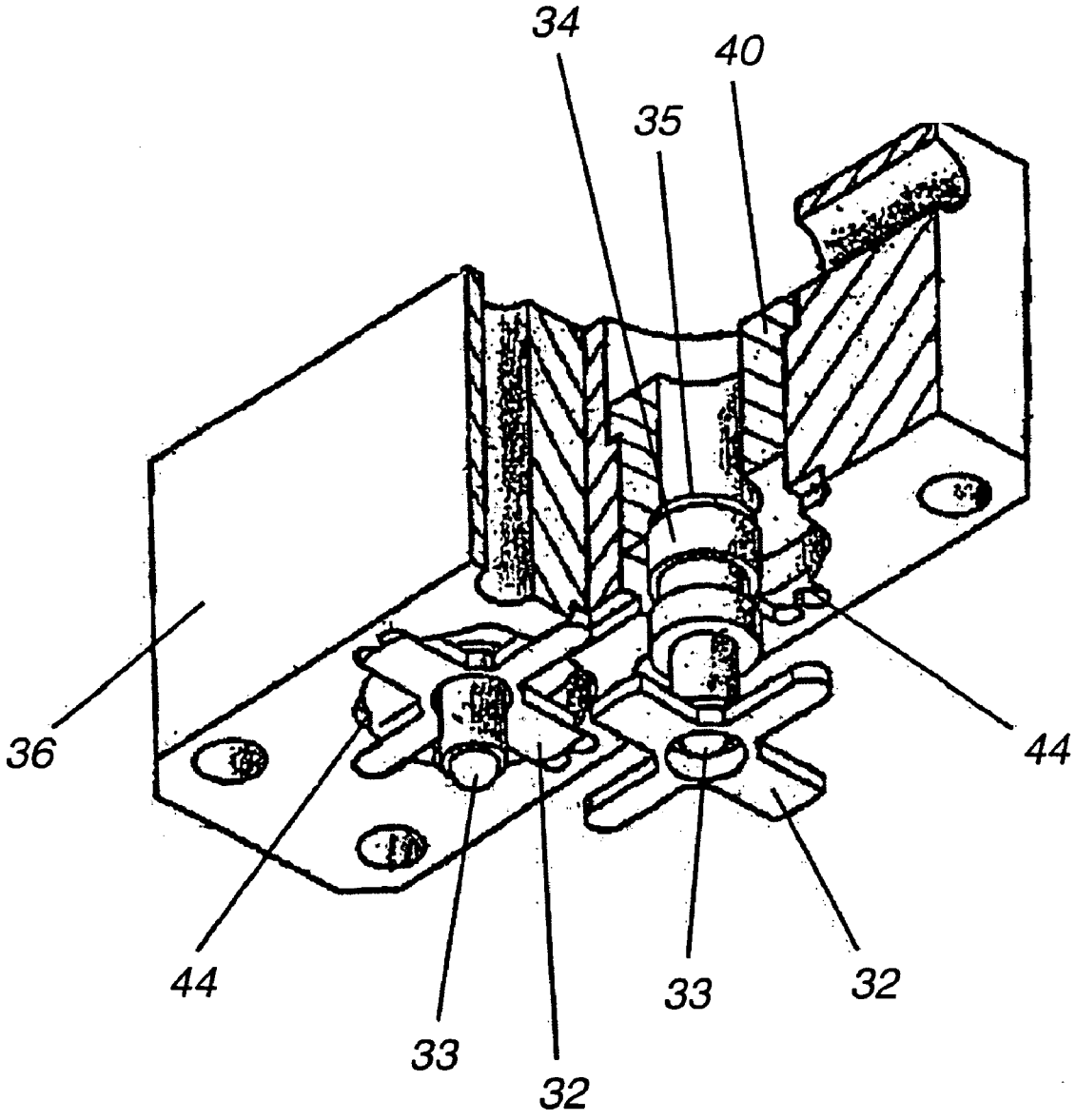
FIG. 4 is a cutaway perspective view of a case portion of a microwave mechanical switch showing damper elements and the recesses provided for the damper elements.

FIG. 4 shows the underside of the case 36 and the reed holders 34 and 34A axially positioned within the bushings 40 which in turn are axially positioned within the holes in the case 36. The dampers 32 are located within damper recesses 44 in the underside of the case 36.

Figure 5:
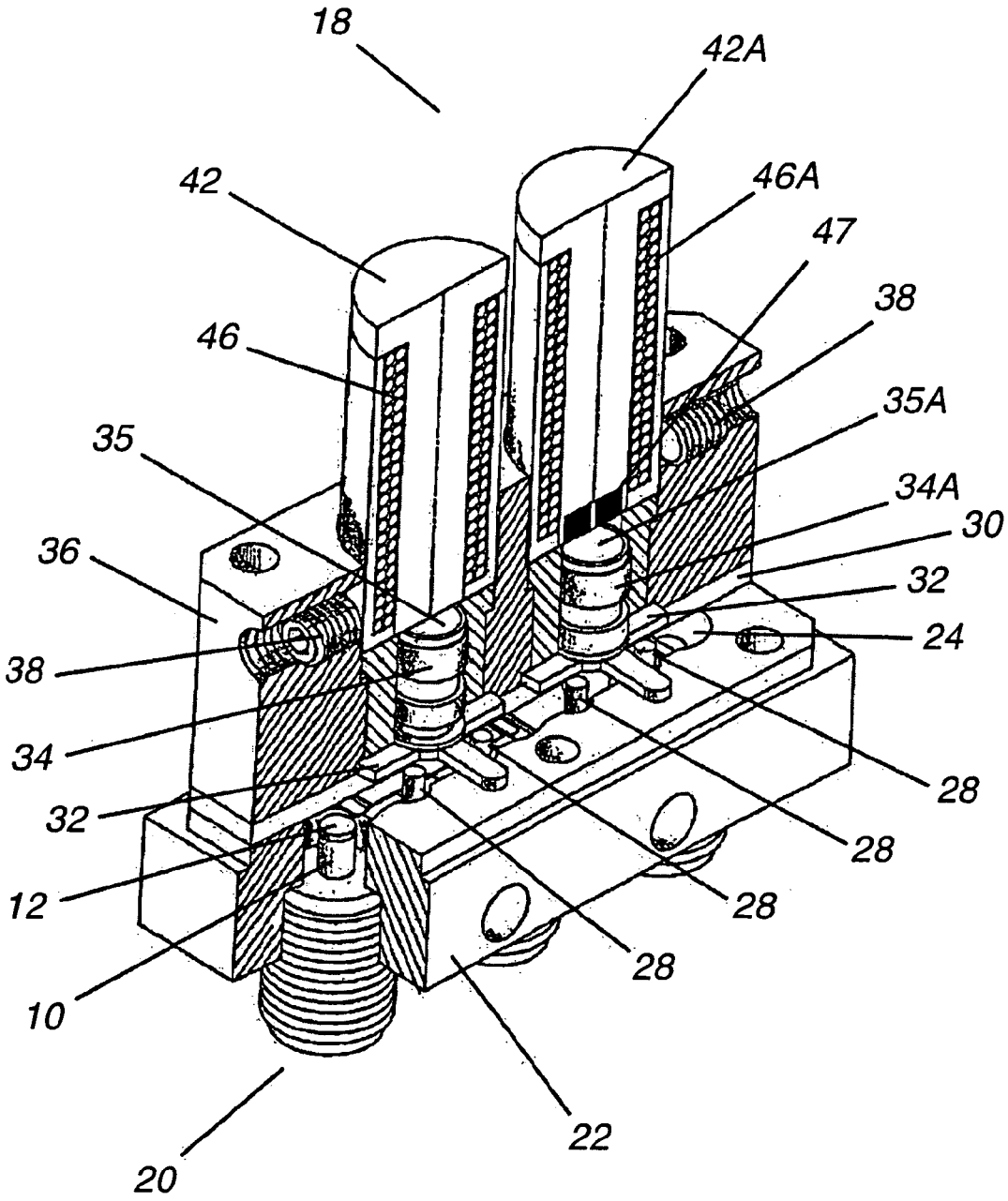
FIG. 5 is a cutaway perspective view of a microwave mechanical switch incorporating damper elements and terminal probe tips.

Referring now to FIG. 5 two types of cores 42 and 42A are shown. Core 42A has a permanent magnet 47 attached to one end. The actuators contain cores 42 and 42A, electromagnetic coils 46 and 46A as shown in the cutaway view of the switch assembly 18 of FIG. 5. The electromagnetic coils 46 and 46A are wound in opposite directions. When no control signal is applied and the coils 46 and 46A are de-energized the magnet 35 is attracted towards the core 42 and the reed holder 34 is retracted, pulling the reed 26, FIG. 3, away from the probe tips 12B and 12C and creating an open circuit. At the same time magnet 35A on the other reed holder 34A is repelled by the magnet 47, and reed holder 34A is driven to cause reed 26A to make contact with probe tips 12A and 12B. When the coils 46 and 46A are energized, the magnet 35 is repelled from the actuator 42 by the electromagnetic field of the coil 46 and the reed holder 34 is extended, pushing the reed 26 towards the probe tips 12B and 12C and creating a closed circuit as the probe tips 12B and 12C contact the tips of the reed 26. At the same time magnet 35A is attracted by actuator 42A, causing reed holder 34A to retract and pull the reed 26A away from probe tips 12A and 12B, thus breaking electrical contact between probe tips 12A and 12B. In the normal mode of single pole double throw (SPDT) switch operation, the coils 46 and 46A of the actuators 42 and 42A are alternately energized and de-energized in pairs so that at any time one of reed holders 34 and 34A is extended and one of reed holders 34 and 34A is retracted, thus producing a closed circuit between one pair of terminals 20 and an open circuit between the other pair of terminals 20.

The dampers 32 cushion the travel end points of the extending direction of the reed holders 34 and 34A. This, in turn, reduces the amount of bounce of the reeds 26 and 26A attached to reed holders 34 and 34A, where bounces occur during establishment of electrical contact between the probe tips 12 and the reeds 26. When the probe tips 12 move into mechanical contact with the tips of the reeds 26, the geometry of the peaks 14 and the valley 16 of the probe tips 12 allows for secure mechanical contact and results in low contact resistance. Additionally, during switch operation the disclosed invention enhances the normal wiping action of a mechanical contact using thin, flexible reed conductors 26 by moving contact wear-induced debris into the valley 16 portions of the probe tips 12. Further enhancement of the debris-capturing properties of the probe tips 12 is achieved by lubricating the probe tips 12 with a lubricant compound. The lubricant improves contact wiping action between the peaks 14 and the tips of the reeds 26 and also serve by capturing debris in the valleys 16. A portion of the lubricant accumulates in the cavities formed by the valleys 16 and serves to further aid in capturing any wear particles. While the portion of the lubricant which becomes dried and contaminated accumulates in the cavities, the remaining fresher lubricant is still available for improving the contact wiping action.

One skilled in the art will recognize that variations of the switch assembly 18 are possible. For example, the actuators 42 and 42A and electromagnetic coils 46 and 46A could be arranged differently than was shown. The permanent magnets 35 and 35A could be replaced with compressed springs to move the reeds 26 and 26A to a closed position. More or fewer reeds 26 and 26A, terminals 20 and actuators 42 and 42A could be used depending on the particular switching configuration that is needed. Even though the switching device is described for RF signals, the switch 18 could be used for any digital or analog signal from DC to very high frequencies.

Another advantage of the present invention is that the use of a separate base 22, midplate 30 and case 36 allows for more precise machining of hole features and locating of components within the hole features. The combination of inventive features yields a switch capable of at least 15 million switching cycles.

Having described herein illustrative embodiments and best mode of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features that have been shown and described, but shall be construed also to cover any obvious modifications and equivalents thereof, such as SPNT, SPNTA transfer and DPDT switches (where N=2, 3 . . . etc. and A is for absorptive).

What is claimed is:

1. A switch comprising:

a base having an upper face and a lower face;

said upper face having at least one slot longitudinally disposed therein;

said base having a first terminal hole and a second terminal hole therethrough between said upper face and said lower face and intersecting said slot;

a case covering said upper face;

a midplate with one or more clearance holes therethrough and through holes arranged around said clearance holes disposed between said upper face and said case;

a first terminal at least partially mounted within said first terminal hole and having a first probe extending into said slot;

said first probe terminating in a first probe tip;

a second terminal at least partially mounted within said second terminal hole and having a second probe extending into said slot;

said second probe terminating in a second probe tip;

said first and second probe tips being formed with a series of peaks and valleys;

a plurality of guide members affixed within said through holes in said middle plate aligned parallel to the axes of said terminal holes and extending into said slot;

an electrically conductive reed mounted between said guide members and extending along said slot and substantially parallel with said upper face, said reed movable between a first position wherein said first and second terminals are electrically connected and a second position wherein said first and second terminals are electrically disconnected;

a reed holder affixed to said reed and reciprocally movable in said case, said reed holder having a first end and a second end, said first end extending through one of said clearance holes of said midplate and mounted to said reed; and, an actuator mounted in said case and magnetically coupled to said second end of said reed holder, said actuator operable to move said reed between said first and second reed positions.

2. A switch comprising:

a base having an upper face and a lower face;

said upper face having at least one slot longitudinally disposed therein;

said base having a first terminal hole, a second terminal hole, and a third terminal hole therethrough between said upper face and said lower face and intersecting said slot;

a midplate covering said upper face;

a case forming in combination with said midplate an RF cavity;

said midplate having one or more clearance holes therethrough and through holes arranged around said clearance holes disposed between said upper face and said case;

a first terminal at least partially mounted within said first terminal hole and having a first probe extending into said slot;

said first probe terminating in a first probe tip;

a second terminal at least partially mounted within said second terminal hole and having a second probe extending into said slot;

said second probe terminating in a second probe tip;

a third terminal at least partially mounted within said third terminal hole and having a third probe extending into said slot;

said third probe terminating in a third probe tip;

said probe tips being formed with a series of peaks and valleys;

a plurality of guide members affixed within said through holes in said middle plate aligned parallel to the axes of said terminal holes and extending into said slot;

a first electrically conductive reed mounted between said guide members and extending along said slot and substantially parallel with said upper face, said first reed reciprocally movable between a first position wherein said first and second terminals are electrically connected and a second position wherein said first and second terminals are electrically disconnected;

a first reed holder affixed to said first reed and slidable in said case, said first reed holder having a first end and a second end, said first end extending through one of said clearance holes of said midplate and mounted to said first reed;

a first actuator mounted in said case and magnetically coupled to said second end of said first reed holder, said first actuator operable to move said first reed between said first and second reed positions;

a second electrically conductive reed mounted between said guide members and extending along said slot and substantially parallel with said upper face, said second reed movable between a first position wherein said second and third terminals are electrically connected and a second position wherein said second and third terminals are electrically disconnected;

a second reed holder affixed to said second reed and slidable in said case, said second reed holder having a first and a second end, said first end extending through one of said clearance holes of said midplate and mounted to said second reed;

a second actuator mounted in said case and magnetically coupled to said second end of said second reed holder, said second actuator operable to move said second reed between said first and second reed positions; and, wherein said first reed and said second reed are driven to oppositely connect to and disconnect from said terminals.

3. A switch as described in claim 2, further comprising:

a damper disposed between said case and said middle plate and axially aligned with said reed holder, whereby said damper provides cushioning as said reed is moved to said first reed position, thereby reducing the bounce in said reed as said reed contacts said first and second probe tips.

4. A switch as described in claim 3, further comprising:

a recess formed in said case opening facing towards said midplate; and, said damper disposed within said recess.

5. A switch as described in claim 4, wherein said damper comprises:

a series of connected arms disposed radially around a central opening, wherein a portion of said reed holder moves through said central opening.

6. A switch as described in claim 3, wherein said damper is composed of an elastic material.

7. A switch as described in claim 2, wherein said probe tips are formed from a metal selected from a group consisting of a noble metal and alloys of noble metals.

8. A switch as described in claim 7, wherein one of said alloys of noble metals is 24 karat gold.

9. A switch as described in claim 2, wherein said series of peaks and valleys comprise a waffle pattern.

10. A switch as described in claim 2, further comprising a lubricant deposited on said probe tip and residing at least partially in said valleys, whereby any wear debris is more efficiently captured within said valleys.

11. A switch capable of at least 15 million cycles of operation comprising:

a base having an upper face and a lower face;

said upper face having at least one slot longitudinally disposed therein;

said base having a first terminal hole and a second terminal hole therethrough between said upper face and said lower face and intersecting said slot;

a midplate covering said upper face;

a case forming in combination with said midplate an RF cavity;

said midplate having one or more clearance holes therethrough and through holes arranged around said clearance holes disposed between said upper face and said case;

a first terminal at least partially mounted within said first terminal hole and having a first probe extending into said slot;

said first probe terminating in a first probe tip;

a second terminal at least partially mounted within said second terminal hole and having a second probe extending into said slot;

said second probe terminating in a second probe tip;

said first and second probe tips are formed from a metal selected from a group consisting of a noble metal and alloys of noble metals with a series of peaks and valleys therewithin;

a plurality of guide members affixed within said through holes in said middle plate aligned parallel to the axes of said terminal holes and extending into said slot;

an electrically conductive reed mounted between said guide members and extending along said slot and substantially parallel with said upper face, said reed movable between a first position wherein said first and second terminals are electrically connected and a second position wherein said first and second terminals are electrically disconnected;

a reed holder affixed to said reed and slidable in said case, said reed holder having a first and a second end, said first end extending through one of said clearance holes of said midplate and mounted to said reed;

an actuator mounted in said case and magnetically coupled to said second end of said reed holder, said actuator operable to move said reed between said first and second reed positions;

a recess formed in said case opening facing towards said midplate;

a damper comprising a series of connected arms disposed radially around a central opening axially aligned with said reed holder, wherein a portion of said reed holder moves through said central opening; and, whereby said damper provides cushioning as said reed is moved to said first reed position, thereby reducing the amount of bounce in said reed as said reed contacts said first and second probe tips.

12. A switch capable of at least 15 million cycles of operation comprising:

a base having an upper face and a lower face;

said upper face having at least one slot longitudinally disposed therein;

said base having a first terminal hole, a second terminal hole and third terminal hole therethrough between said upper face and said lower face and intersecting said slot;

a midplate covering said upper face;

a case forming in combination with said midplate an RF cavity;

said midplate having one or more clearance holes therethrough and through holes arranged around said clearance holes disposed between said upper face and said case;

a first terminal at least partially mounted within said first terminal hole and having a first probe extending into said slot;

said first probe terminating in a first probe tip;

a second terminal at least partially mounted within said second terminal hole and having a second probe extending into said slot;

said second probe terminating in a second probe tip;

a third terminal at least partially mounted within said third terminal hole and having a third probe extending into said slot;

said third probe terminating in a third probe tip;

said first, second and third probe tips being formed from a metal selected from a group consisting of a noble metal and alloys of noble metals with a series of peaks and valleys therewithin;

a plurality of guide members affixed within said through holes in said middle plate aligned parallel to the axes of said terminal holes and extending into said slot;

a first electrically conductive reed mounted between said guide members and extending along said slot and substantially parallel with said upper face, said first reed movable between a first position wherein said first and second terminals are electrically connected and a second position wherein said first and second terminals are electrically disconnected;

a first reed holder affixed to said first reed and slidable in said case, said first reed holder having a first and a second end, said first end extending through one of said clearance holes of said midplate and mounted to said first reed;

a first actuator mounted in said case and magnetically coupled to said second end of said first reed holder, said first actuator operable to move said first reed between said first and second reed positions;

a second electrically conductive reed mounted between said guide members and extending along said slot and substantially parallel with said upper face, said second reed movable between a first position wherein said second and third terminals are electrically connected and a second position wherein said second and third terminals are electrically disconnected;

a second reed holder affixed to said second reed and slidable in said case, said second reed holder having a first and a second end, said first end extending through one of said clearance holes of said midplate and mounted to said second reed;

a second actuator mounted in said case and magnetically coupled to said second end of said second reed holder, said second actuator operable to move said second reed between said first and second reed positions;

wherein said first reed and said second reed are driven to oppositely connect to and disconnect from said terminals;

a recess formed in said case opening facing towards said midplate;

a first and a second damper each comprising a series of connected arms disposed radially around a central opening axially aligned with said first and second reed holders, wherein a portion of each of said reed holders moves through said central opening; and, whereby said dampers provide cushioning as said reeds are moved to said first reed position, thereby reducing the bounce in said reeds as said reeds contact said probe tips.

13. A switch as described in claim 12, wherein one of said alloys of noble metals is 24 karat gold.

14. A switch as described in claim 12, wherein said series of peaks and valleys comprise a waffle pattern.

15. A switch as described in claim 12, further comprising a lubricant deposited on said probe tip and residing at least partially in said valleys, whereby any wear debris is more efficiently captured within said valleys.

16. A switch as described in claim 12, wherein said damper is composed of an elastic material.

* * * * *